US009437963B1

(12) United States Patent
DeJesu

(10) Patent No.: US 9,437,963 B1
(45) Date of Patent: Sep. 6, 2016

(54) STRAIN RELIEVER HAVING TWO DIFFERENT PORTIONS ENCIRCLING TWO DIFFERENT PORTIONS OF A CONNECTOR OF A CABLE

(71) Applicant: Troy DeJesu, Bayville, NY (US)

(72) Inventor: Troy DeJesu, Bayville, NY (US)

( * ) Notice: Subject to any disclaimer, the term of this patent is extended or adjusted under 35 U.S.C. 154(b) by 0 days.

(21) Appl. No.: 14/815,175

(22) Filed: Jul. 31, 2015

(51) Int. Cl.
*H01R 13/58* (2006.01)

(52) U.S. Cl.
CPC ..... *H01R 13/58* (2013.01)

(58) Field of Classification Search
CPC H01R 13/58; H01R 13/5804; H01R 13/595; H01R 23/661; H01R 13/5837
USPC ..... 439/445, 449, 451, 452, 455
See application file for complete search history.

(56) References Cited

U.S. PATENT DOCUMENTS 4,323,727 A 4/1982 Berg
4,367,967 A 1/1983 Albert, Jr.
5,211,576 A 5/1993 Tonkiss et al.
5,744,754 A 4/1998 Strang et al.
6,068,506 A * 5/2000 Shen ..... H01R 13/562 439/447
6,488,317 B1 12/2002 Daoud
6,523,584 B1 2/2003 Rehrig
7,331,613 B2 * 2/2008 Schulte ..... A61M 39/1011 285/239
2011/0256755 A1 * 10/2011 Montena ..... H01R 13/5213 439/449
2012/0178283 A1 * 7/2012 Crooijmans ..... H01R 24/58 439/449
2012/0231653 A1 * 9/2012 Ardisana ..... H01R 13/562 439/449
2013/0005169 A1 1/2013 Soltis et al.
2013/0217257 A1 * 8/2013 Bogart ..... H01R 13/213 439/372
2016/0013581 A1 * 1/2016 Wu ..... H01R 13/5845 439/452
2016/0079717 A1 * 3/2016 Bogart ..... H01R 13/6392 439/449

FOREIGN PATENT DOCUMENTS

CA 2152419 6/1995

* cited by examiner

*Primary Examiner* — Chandrika Prasad
(74) *Attorney, Agent, or Firm* — Richard L. Miller

(57) ABSTRACT

A strain reliever that relieves strain on a cable (particularly a Lightning® cable) having a connector with a first portion and a second portion that are coaxially disposed and of different widths so as to form a first shoulder therebetween. The width of the cable is different from the width of the second portion of the connector of the cable so as to form a second shoulder therebetween. The strain reliever includes a first portion and a second portion. The first portion encircles the first portion of the connector of the cable. The second portion extends from the first portion, and encircles the second portion of the connector of the cable.

20 Claims, 5 Drawing Sheets

STRAIN RELIEVER HAVING TWO DIFFERENT PORTIONS ENCIRCLING TWO DIFFERENT PORTIONS OF A CONNECTOR OF A CABLE

BACKGROUND OF THE INVENTION

1. Field of the Invention

The present invention relates to a strain relief, and more particularly, a strain relief for an electronic cable.

2. Description of the Prior Art

A Lightning® cable connector is a proprietary computer bus and power connector created by Apple® Inc. to replace its previous proprietary 30-pin dock connector used to connect Apple mobile devices like the iPhones®, the iPads®, and the iPods® to host computers, external monitors, cameras, USB battery chargers, and other peripherals.

Using eight pins instead of thirty, the Lightning® cable connector is significantly more compact than the 30-pin dock connector, and can be inserted with either side facing up.

The Lightning® cable connector was introduced in 2012, and as of November 2014, is used by the iPhone 5® onwards, the iPod Touch® (5th generation), the iPad® (4th generation) onwards, the iPad Mini® and the iPod Nano® (7th generation).

Numerous innovations for cable strain relief devices have been provided in the prior art that will be described. Even though these innovations may be suitable for the specific individual purposes to which they address, however, they differ from the present invention.

A FIRST EXAMPLE, U.S. Pat. No. 4,323,727, Issued on Apr. 6, 1982, to Berg teaches a cable strain relief and sealing apparatus including a sleeve formed of flexible and resilient material having a substantially cylindrical inner surface and a tapered outer surface. The sleeve is tapered inwardly from the mid-portion thereof to both end portions thereof, or alternatively, is provided with a taper in one direction only. A plurality of oppositely extending axial slots are formed in the sleeve so that upon radial inward compression of the sleeve by a housing member or the like enclosing the sleeve, the internal surface of the sleeve will tightly grip a cable passing therethrough. A sealing bushing formed of flexible and resilient material is provided at each tapered end of the sleeve, and have a taper that is substantially the same as that of the sleeve. Each bushing includes an annular flange that extends within the adjacent end of the sleeve so that a tight sealing engagement between the sleeve, the bushing, and the cable is effected upon compression of the sleeve and the bushing by the surrounding housing members.

A SECOND EXAMPLE, U.S. Pat. No. 4,367,967, Issued on Jan. 11, 1983, to Albert, Jr. teaches a bending strain relief device in the form of an elongated tubular member having a longitudinal axis and including a plurality of rigid sleeve members positioned one after another along the axis. The sleeve members are connected together only by elastomeric material that deforms and flows elastically during relative angular movement between adjacent sleeve members for imparting curvature to the tubular member. Adjacent sleeve members have cooperating surfaces that interfere with each other to effectively limit the maximum degree of relative angular movement and thereby limit the degree of curvature that can be imparted to the tubular member.

A THIRD EXAMPLE, U.S. Pat. No. 5,211,576, Issued on May 18, 1993, to Tonkiss, et al. teaches a cable clamp that relieves stress between a cable and a connector with which the cable is associated. The cable clamp includes a body defining a passageway through which a cable passes and has threads. A strain relief clamp is positioned internal to the body for clamping a cable relative to the body when the cable is passed through the body. A clamp actuator assembly is threaded onto the threads of the body to actuate the strain relief clamp. Serrations are provided for inhibiting unthreading of the clamp actuator element. In an alternative embodiment of the cable clamp, the clamp actuator assembly includes a non-rotating element floating with respect to a clamp nut and engaging the strain relief clamp so that as the clamp nut is threaded onto the body, the clamp clamps the cable more tightly.

A FOURTH EXAMPLE, U.S. Pat. No. 5,744,754, Issued on Apr. 28, 1998, to Strang, et al. teaches a strain relief arrangement for electrical wires or cables, and more particularly, an electrical receptacle or housing incorporating an integral strain relief arrangement for electrical transmission cables or wires. The electrical receptacle has a rear wall structure including holes or apertures for the passage therethrough of electrical wires or cables and in which each of the holes possesses a configuration adapted to incorporate a strain relief arrangement for the electrical wires or cables.

A FIFTH EXAMPLE, U.S. Pat. No. 6,068,506, Issued on May 30, 2000, to Shen teaches a strain relief device adapted to be interposed between an end portion of an electrical cable and an electrical connector. The strain relief device includes a sheath that is adapted to be injection molded on the cable and which is adapted to be held on the connector. A rigid sleeve has an enlarged inner end portion and an enlarged outer end portion, and is adapted to be interposed between the sheath and the cable in such a manner that a connecting end portion of the cable is press fitted within the enlarged inner end portion of the sleeve, and that the sheath is injection molded on the assembly of the cable and the sleeve. The enlarged inner and outer end portions of the sleeve define an annular groove therebetween in an outer surface of the sleeve. The sheath has an inward flange that projects radially and inwardly therefrom to engage fittingly the annular groove in the sleeve, thereby preventing removal of the sleeve and the cable from the sheath.

A SIXTH EXAMPLE, U.S. Pat. No. 6,488,317, Issued on Dec. 3, 2002, to Daoud teaches a strain relief including a main body having a bore therein for passage of a cable, wire, conduit, hose, or similar member therethrough. The main body includes a first section having male threads, and a second section including a plurality of cantilevered deflectable prongs extending therefrom. A plurality of slots are located between the prongs, and the prongs decrease in width extending toward distal ends of the prongs. A flexible elastomeric grommet is located within the bore and extends substantially along an entire length of the main body. The grommet includes a cylindrical sidewall and a plurality of spaced-apart annular ribs extending radially inwardly from the sidewall. A plurality of annular grooves are located between the annular ribs. The annular ribs have inside diameters that progressively increase along a length of the grommet in order to accommodate cables of various diameters therethrough. A silicone gel is located in the annular grooves. A cap is provided that includes female threads that are engagable with the male threads of the main body for securing the cap to the main body. The cap further includes a conically or arcuately tapered wall engagable with distal ends of the prongs for compressing the prongs inwardly when the cap is threaded onto the main body, thereby compressing the grommet inwardly around the cable.

A SEVENTH EXAMPLE, U.S. Pat. No. 6,523,584, Issued on Feb. 25, 2003, to Rehrig teaches a cable cover for use with welding and cutting apparatus to protect and bundle together the power and any fluid-carrying lines extending from the torch handle. The cover includes an elongated panel formed of a flexible and durable material and has substantially parallel edge portions adapted to be secured together about the torch lines. A zipper is carried by the edge portions for securing the edge portions together over a first major portion of the cover. Strips of hook and loop fasteners are carried by the edge portions of the panel over the last two to three feet of the cover. Thus, a major portion of the cover is secured about the torch lines using the zipper fastener, and one or more torch lines exit the cover laterally at desired locations through the hook and loop fastener proximate the power supply.

AN EIGHTH EXAMPLE, U.S. Pat. No. 7,331,613, Issued on Feb. 19, 2008, to Schulte teaches a connector assembly for interconnecting separate sections of tubing, e.g., medical tubing. Connector assemblies are a two-piece construction having a connector pin and a connector sleeve. The connector sleeve includes a first end, a second end, and a passageway extending between the first and second ends. The passageway is stepped, e.g., defined by both a bore of a first diameter and a bore of a second diameter.

A NINTH EXAMPLE, U.S. Patent Office Document No. 2012/0231653, Published on Sep. 13, 2012, to Ardisana, et al. teaches strain-relief members for cables and methods for making the same. The strain-relief members are constructed to have one or more tuning members that provide selective strain relief for the cable. Each tuning member varies the wall thickness of the strain relief member, and depending on several factors, such as, how many tuning members are present, their shape, and their positions within the strain-relief member, the strain-relief member is specifically tailored to meet desired strain relief characteristics.

A TENTH EXAMPLE, U.S. Patent Office Document No. 2013/0005169, Published on Jan. 3, 2013, to Soltis, et al. teaches a lead assembly for an implantable medical device, which includes a lead body having a proximal end, a distal end, and a longitudinal axis that extends between the proximal end and the distal end. The lead assembly also includes a strain relief tube that surrounds a portion of the lead body. The strain relief tube includes a flexible material configured to include contours so that the portion of the lead body surrounded by the strain relief tube maintains a formed shape that varies from the longitudinal axis of the lead body. The contours vary in response to forces on the lead body to prevent strain at the distal end of the lead body.

AN ELEVENTH EXAMPLE, APPLICATION FOR CANADIAN PATENT Document No. CA2152419, Published/Issued on Des. 12, 1995, to Burt, et al. teaches a strain relief sleeve for use in conjunction with a standard in-line telephone-type modular plug having a multi-wire cable inserted thereinto. The strain relief sleeve includes a main body in the form of a shell having walls of predetermined thickness. The main body has a cable-engaging portion and a plug-engaging portion, and includes substantially identical first and second body portions. The first and second body portions have co-operating opposed mating surfaces at the outer end of each of the side wall members that faces the respective outer end of the wall member of the other of the first and second body portions. An internal gripping surface on the cable-engaging portion is shaped and dimensioned so as to intimately engage the jacket of the inserted cable in unmoving relation thereto, to thereby cause the cable-engaging portion to securely grip the inserted cable in movement precluding relation. An internal engaging surface on the plug-engaging portion is shaped and dimensioned so as to intimately engage the exterior surface of the plug in unmoving relation thereto, to thereby cause the plug-engaging portion to securely grip the plug in movement precluding relation. When tensile forces are generated in the jacket of the cable from pulling on the cable, the forces are generally transmitted from the cable to the cable-engaging portion, through the main body, to the plug-engaging portion, and ultimately to the plug.

It is apparent now that numerous innovations for cable strain relief devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a strain relief for an electronic cable that avoids the disadvantages of the prior art.

ANOTHER OBJECT of the present invention is to provide a strain relief for an electronic cable that is simple and inexpensive to manufacture.

STILL ANOTHER OBJECT of the present invention is to provide a strain relief for an electronic cable that is simple to use.

BRIEFLY STATED, STILL YET ANOTHER OBJECT of the present invention is to provide a strain reliever that relieves strain on a cable (particularly a Lightning® cable) having a connector with a first portion and a second portion that are coaxially disposed and of different widths so as to form a first shoulder therebetween. The width of the cable is different from the width of the second portion of the connector of the cable so as to form a second shoulder therebetween. The strain reliever includes a first portion and a second portion. The first portion encircles the first portion of the connector of the cable. The second portion extends from the first portion, and encircles the second portion of the connector of the cable.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Introductory

Figure 1:
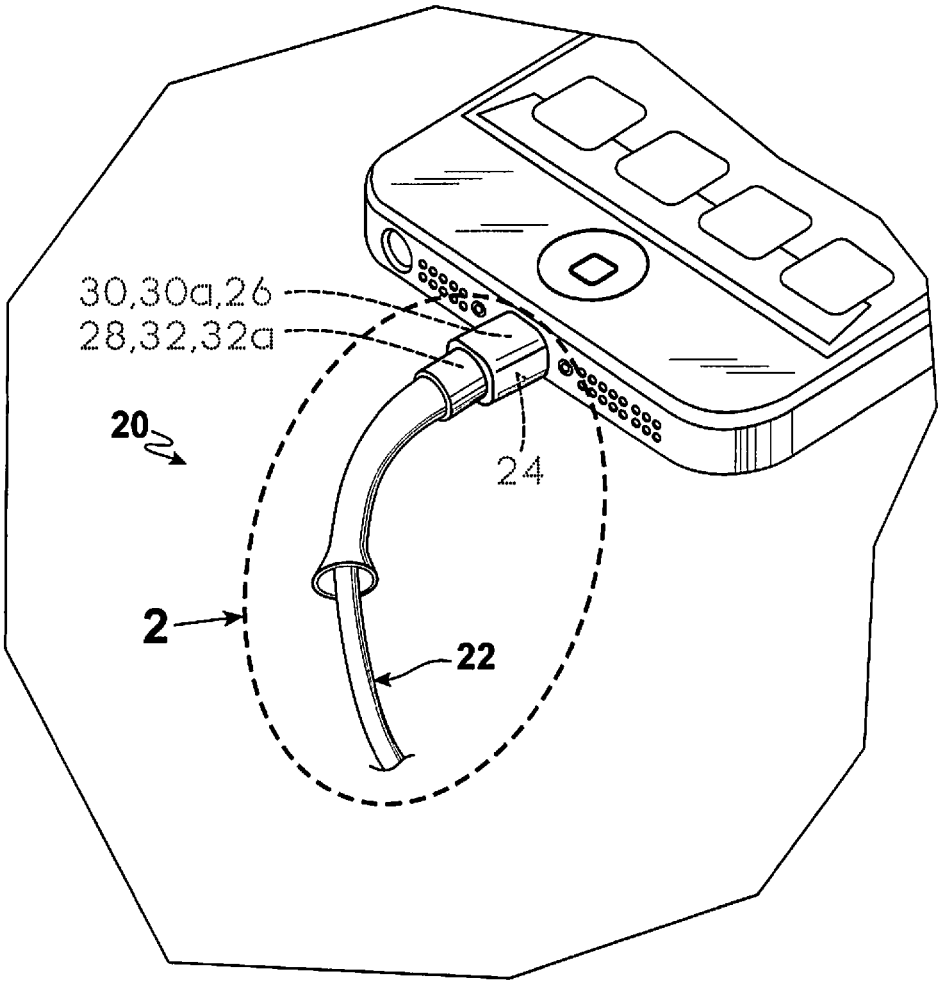
FIG. 1 is a diagrammatic perspective view with parts broken away illustrating an electronic cable being plugged into a cell phone with a an embodiment of a strain relief for an electronic cable of the present invention installed thereon.
Figure 2:
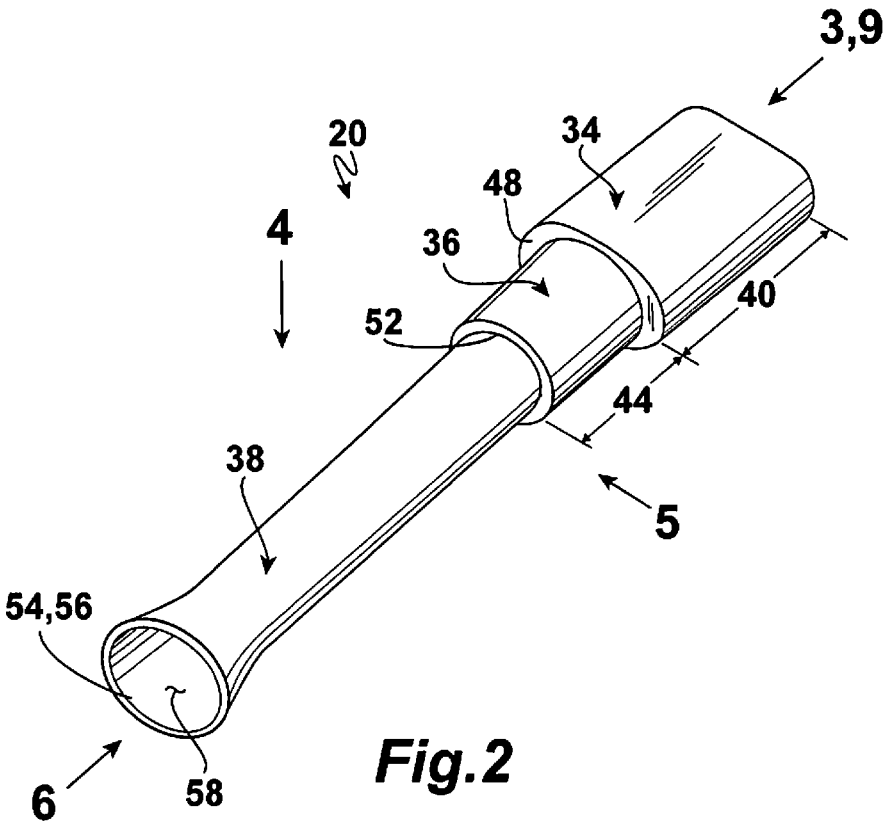
FIG. 2 is a diagrammatic perspective view, of the area enclosed in the dotted curve indicated by arrow 2 in FIG. 1, of an embodiment of the strain relief for an electronic cable per se.
Figure 3:
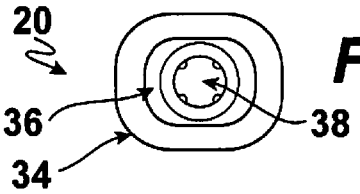
FIG. 3 is a proximal end view thereof taken in the direction of arrow 3 in FIG. 2.
Figure 4:
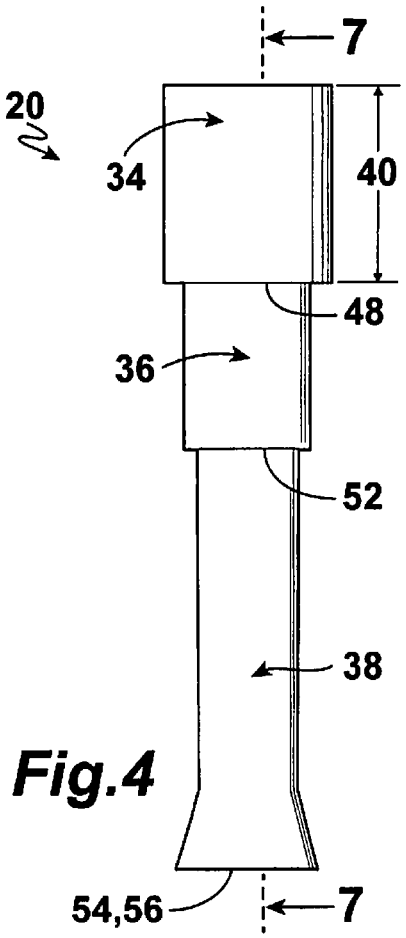
FIG. 4 is a top plan view taken in the direction of arrow 4 in FIG. 2, the bottom plan view being a mirror image thereof.
Figure 5:
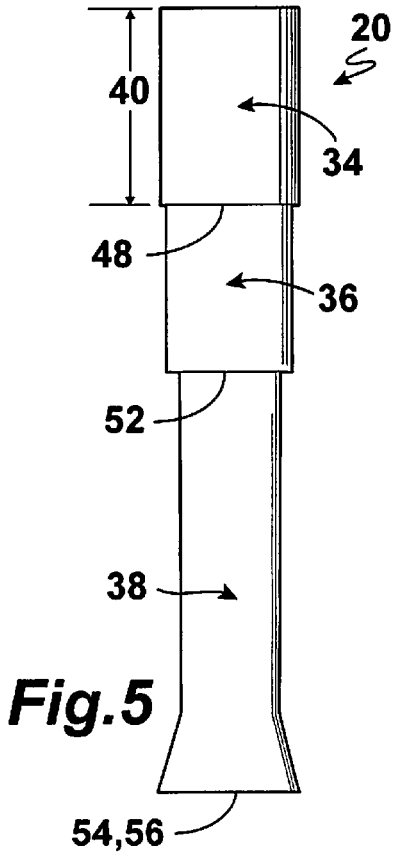
FIG. 5 is a side elevational view taken in the direction of arrow 5 in FIG. 2, the opposite side view being a mirror image thereof.
Figure 6:
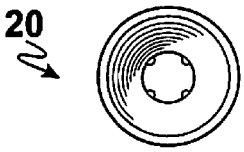
FIG. 6 is a distal end view thereof taken in the direction of arrow 6 in FIG. 2.
Figure 7:
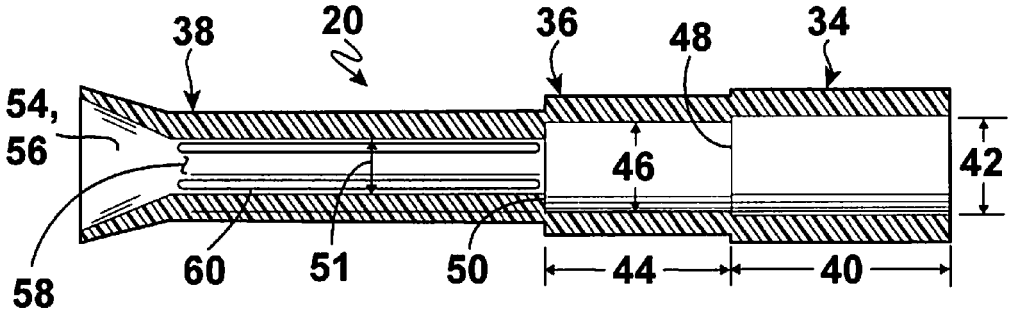
FIG. 7 is a cross sectional view taken on line 7-7 in FIG. 4.
Figure 8:
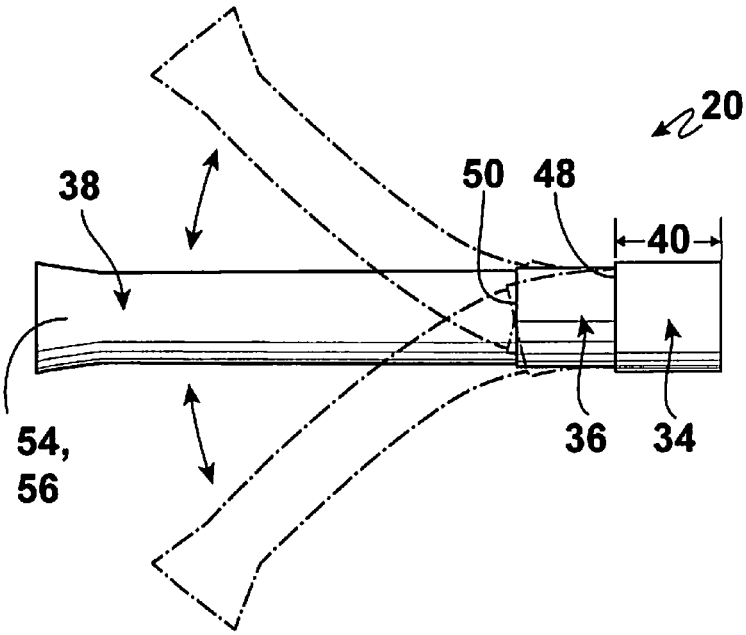
FIG. 8 is a side elevational view an embodiment of the strain relief for an electronic cable per se, showing in phantom how the strain relief can flex.

20 strain reliever of embodiments of present invention for relieving strain on cable 22 having connector 24 with first portion 26 and second portion 28, respectively, that are coaxially disposed and are of first outer width 30 and second outer width 32, respectively, that are different from each other so as to form first shoulder therebetween, and outer width of cable 22 is different from second outer width 32 of second portion 28 of connector 24 of cable 22 so as to form second shoulder therebetween

22 cable

24 connector of cable 22

26 first portion of connector 24 of cable 22

28 second portion of connector 24 of cable 22

30 first outer width of first portion 26 of connector 24 of cable 22

30*a* first length of first portion 26 of connector 24 of cable 22

32 second outer width of second portion 28 of connector 24 of cable 22

32*a* second length of second portion 28 of connector 24 of cable 22

Overall Configuration of Strain Reliever 20

34 first portion for encircling first portion 26 of connector 24 of cable 22

36 second portion for encircling second portion 28 of connector 24 of cable 22

38 third portion for encircling cable 22

Specific Configuration of First Portion 34

40 first length of first portion 34 for being equal to first length 30*a* of first portion 26 of connector 24 of cable 22 for providing snug fit

42 first inner width of first portion 34 for being equal to first outer width 30 of first portion 26 of connector 24 of cable 22 for providing snug fit

Specific Configuration of Second Portion 36

44 second length of second portion 36 for being equal to second length 32*a* of second portion 28 of connector 24 of cable 22 for providing snug fit

46 second inner width of second portion 36 for being equal to second outer width 32 of second portion 36 of connector 24 of cable 22 for providing snug fit

48 first shoulder between first portion 34 and second portion 36 for sitting against first shoulder between first portion 26 of connector 24 of cable 22 and second portion 28 of connector 24 of cable 22 for providing a snug fit

Specific Configuration of Third Portion 38

50 second shoulder between second portion 36 and third portion 38

51 third inner width of third portion 38

54 free distal end of third portion 38

56 flared distal end of free distal end 54 of third portion 38 for facilitating passing over connector 24 of cable 22 during installation

58 inner surface of third portion 38

60 axial protrusions of inner surface 58 of third portion 38 for contacting cable 22 after third portion 38 has compressed back after installation thereof

DETAILED DESCRIPTION OF THE PREFERRED EMBODIMENT

Introductory

Figure 9:
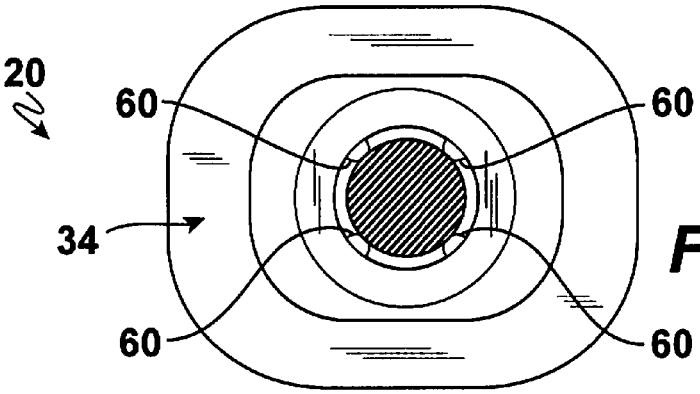
FIG. 9 is an enlarged proximal end view, similar to FIG. 3, taken in the direction of arrow 3 in FIG. 2.
Figure 10:
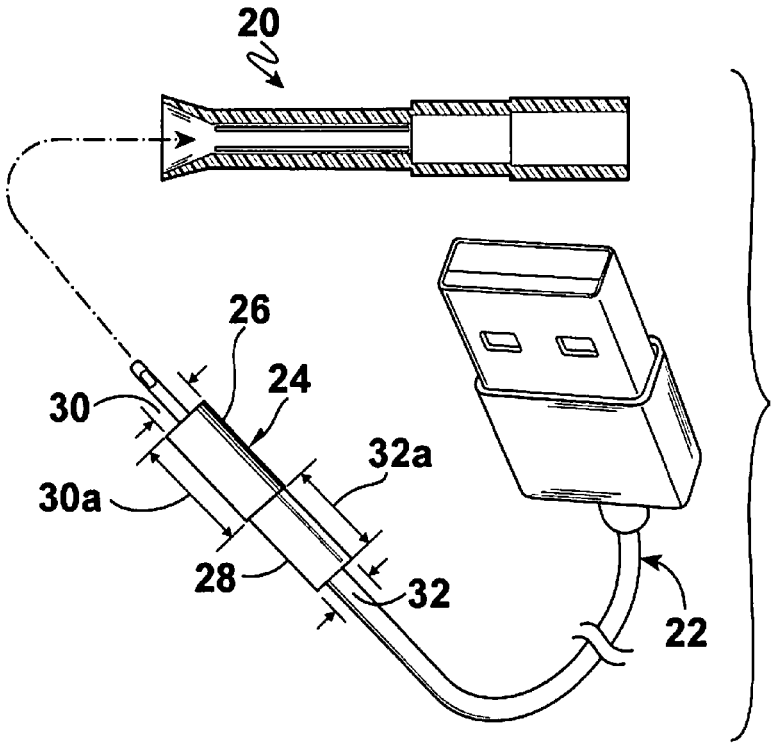
FIG. 10 a diagrammatic partially in cross section and partially perspective view illustrating the strain relief about to be stretched over an electronic cable.
Figure 11:
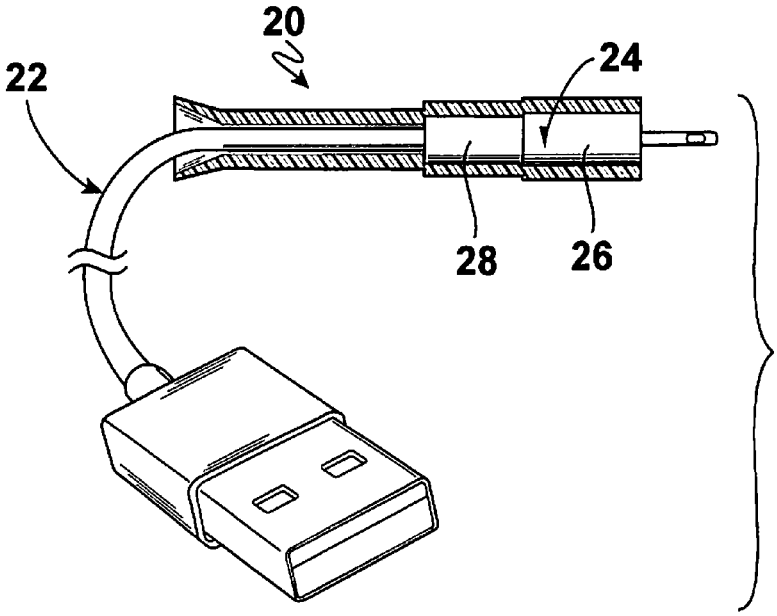
FIG. 11 is a cross sectional view taken on line 7-7 in FIG. 4, with an electronic cable installed therein.

Referring now to the figures, in which like numerals indicate like parts, and particularly to FIGS. 1, 9, and 10, the strain reliever of the embodiments of the present invention is shown generally at 20 for relieving strain on a cable 22. The cable 22 has an outer width and a connector 22. The connector 24 of the cable 22 has a first portion 26 and a second portion 28. The first portion 26 of the connector 24 of the cable 22 and the second portion 28 of the connector 24 of the cable 22 are coaxially disposed. The first portion 26 of the connector 24 of the cable 22 has a first outer width 30, a first length 30*a*, and a first outer shape. The second portion of the connector 24 of the cable 22 has a second outer width 32, a second length 32*a*, and a second outer shape. The first outer width 30 of the first portion 26 of the connector 24 of the cable 22 is different than the second outer width 32 of the second portion 28 of the connector 24 of the cable 22 so as to form a first shoulder therebetween. The outer width of the cable 22 is different from the second outer width of the second portion 28 of the connector 24 of the cable 22 so as to form a second shoulder therebetween.

Overall Configuration of the Strain Reliever 20

The overall configuration of the strain reliever 20 can best be seen in FIGS. 2-9, and as such, will be discussed with reference thereto.

The strain reliever 20 comprises a first portion 34 and a second portion 36. The first portion 34 is for encircling the first portion 26 of the connector 24 of the cable 22. The second portion 36 extends from the first portion 34, and is for encircling the second portion 28 of the connector 24 of the cable 22.

The strain reliever 20 further comprises a third portion 38. The third portion 38 extends from the second portion 36, and is for encircling the cable 22.

Specific Configuration of the First Portion 34

The specific configuration of the first portion 34 can best be seen in FIGS. 2-9, and as such, will be discussed with reference thereto.

The first portion 34 is a tubular sleeve, and has a first length 40 for being equal to the first length 30*a* of the first portion 26 of the connector 24 of the cable 22 for providing a snug fit, a first inner width 42 for being equal to the first outer width 30 of the first portion 26 of the connector 24 of the cable 22 for providing a snug fit, a first inner shape for being equal to the first outer shape of the first portion 26 of the connector 24 of the cable 22 for providing a snug fit, and is made of a pliable and flexible material, such as silicone rubber, for compressing around the first portion 26 of the connector 24 of the cable 22 for providing a snug fit.

Specific Configuration of the Second Portion 36

The specific configuration of the second portion 36 can best be seen in FIGS. 2-9, and as such, will be discussed with reference thereto.

The second portion 36 extends coaxially from the first portion 34.

The second portion 36 is a tubular sleeve, and has a second length 44 for being equal to the second length 32*a* of the second portion 28 of the connector 24 of the cable 22 for providing a snug fit, a second inner width 46 for being equal to the second outer width 32 of the second portion 36 of the connector 24 of the cable 22 for providing a snug fit, a second inner shape for being equal to the second outer shape of the second portion 36 of the connector 24 of the cable 22 for providing a snug fit, and is made of a pliable and flexible material, such as silicone rubber, for compressing around the second portion 36 of the connector 24 of the cable 22 for providing a snug fit.

The second inner width 46 of the second portion 36 is less than the first inner width 42 of the first portion 34 so as to form a first shoulder 48 therewith. The first shoulder between the first portion 26 of the connector 24 of the cable 22 and the second portion 28 of the connector 24 of the cable 22 is for sitting against the first shoulder 48 between the first portion 34 and the second portion 36 for providing a snug fit.

Specific Configuration of the Third Portion 38

The specific configuration of the third portion 38 can best be seen in FIGS. 2-9, and as such, will be discussed with reference thereto.

The third portion 38 extends coaxially from the second portion 36.

The third portion 38 is a tubular sleeve, has a third inner width 51, and is made of a pliable and flexible material, such as silicone rubber.

The third inner width 51 of the third portion 38 is less than the second inner width 46 of the second portion 36 so as to form a second shoulder 50 therewith. The second shoulder between the second portion 28 of the connector 24 of the cable 22 and the cable 22 is for sitting against the second shoulder 50 between the second portion 36 and the third portion 38 for providing a snug fit.

The third portion 38 further has a free distal end 54.

The free distal end 54 of the third portion 38 is a flared distal end 56. The flared distal end 56 of the free distal end 54 of the third portion 38 is for facilitating passing over the connector 24 of the cable 22 during installation.

The third portion 38 further has an inner surface 58.

The inner surface 58 of the third portion 38 has axial protrusions 60 therealong. The axial protrusions 60 of the inner surface 58 of the third portion 38 are for contacting the cable 22 after the third portion 38 has compressed back after installation thereof.

Impressions

It will be understood that each of the elements described above, or two or more together, may also find a useful application in other types of constructions differing from the types described above.

While the invention has been illustrated and described as embodiments of a strain relief for an electronic cable, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A strain reliever for relieving strain on a cable;
wherein the cable has:
a) an outer width; and
b) a connector;
wherein the connector of the cable has:
a) a first portion; and
b) a second portion;
wherein the first portion of the connector of the cable and the second portion of the connector of the cable are coaxially disposed;
wherein the first portion of the connector of the cable has:
a) a first outer width;
b) a first length; and
c) a first outer shape;
wherein the second portion of the connector of the cable has:
a) a second outer width;
b) a second length; and
c) a second outer shape;
wherein the first outer width of the first portion of the connector of the cable is different than the second outer width of the second portion of the connector of the cable so as to form a first shoulder therebetween;
wherein the outer width of the cable is different than the second outer width of the second portion of the connector of the cable so as to form a second shoulder therebetween;
and wherein said strain reliever comprising:
a) a first portion; and
b) a second portion;
wherein said first portion is for encircling the first portion of the connector of the cable;
wherein said second portion extends from said first portion; and
wherein said second portion is for encircling the second portion of the connector of the cable.

2. The strain reliever of claim 1, further comprising a third portion; and
wherein said third portion is for encircling the cable.

3. The strain reliever of claim 2, wherein said third portion extends from said second portion.

4. The strain reliever of claim 2, wherein said first portion is a tubular sleeve;
wherein said first portion has:
a) a first length;
b) a first inner width; and c) a first inner shape;

wherein said first length of said first portion is for being equal to the first length of the first portion of the connector of the cable for providing a snug fit;

wherein said first inner width is for being equal to the first outer width of the first portion of the connector of the cable for providing a snug fit; and wherein said first inner shape of said first portion is for being equal to the first outer shape of the first portion of the connector of the cable for providing a snug fit.

5. The strain reliever of claim 1, wherein said first portion is made of a pliable and flexible material; and wherein said pliable and flexible material of said first portion is for compressing around the first portion of the connector of the cable for providing a snug fit.

6. The strain reliever of claim 5, wherein said pliable and flexible material of said first portion is silicone rubber.

7. The strain reliever of claim 1, wherein said second portion extends coaxially from said first portion.

8. The strain reliever of claim 4, wherein said second portion is a tubular sleeve;

wherein said second portion has a second length;

wherein said second length of said second portion is for being equal to the second length of the second portion of the connector of the cable for providing a snug fit;

wherein said second portion has a second inner width;

wherein said second inner width of said second portion is for being equal to the second outer width of the second portion of the connector of the cable for providing a snug fit;

wherein said second portion has a second inner shape; and wherein said inner shape of said second portion is for being equal to the second outer shape of the second portion of the connector of the cable for providing a snug fit.

9. The strain reliever of claim 1, wherein said second portion is made of a pliable and flexible material; and wherein said pliable and flexible material of said second portion is for compressing around the second portion of the connector of the cable for providing a snug fit.

10. The strain reliever of claim 9, wherein said pliable and flexible material of said second portion is silicone rubber.

11. The strain reliever of claim 8, wherein said second inner width of said second portion is less than said first inner width of said first portion so as to form a first shoulder therewith; and wherein the first shoulder between the first portion of the connector of the cable and the second portion of the connector of the cable is for sitting against said first shoulder between said first portion and said second portion for providing a snug fit.

12. The strain reliever of claim 2, wherein said third portion extends coaxially from said second portion.

13. The strain reliever of claim 8, wherein said third portion is a tubular sleeve; and wherein said third portion has a third inner width.

14. The strain reliever of claim 2, wherein said third portion is made of a pliable and flexible material.

15. The strain reliever of claim 14, wherein said pliable and flexible material of said third portion is silicone rubber.

16. The strain reliever of claim 13, wherein said third inner width of said third portion is less than said second inner width of said second portion so as to form a second shoulder therewith; and wherein the second shoulder between the second portion of the connector of the cable and the cable is for sitting against said second shoulder between said second portion and said third portion for providing a snug fit.

17. The strain reliever of claim 2, wherein said third portion has a free distal end.

18. The strain reliever of claim 17, wherein said free distal end of said third portion is a flared distal end; and wherein said flared distal end of said free distal end of said third portion is for facilitating passing over the connector of the cable during installation.

19. The strain reliever of claim 2, wherein said third portion has an inner surface.

20. The strain reliever of claim 19, wherein said inner surface of said third portion has axial protrusions therealong; and wherein said axial protrusions of said inner surface of said third portion is for contacting the cable after said third portion has compressed back after installation thereof.

* * * * *